United States Patent [19]

Tucker

[11] Patent Number: 4,498,628

[45] Date of Patent: Feb. 12, 1985

[54] BUTTERFLY SPRINKLER

[75] Inventor: Alfred D. Tucker, Adelaide, Australia

[73] Assignee: RIS Irrigation Systems Pty Ltd, Elizabeth, Australia

[21] Appl. No.: 285,089

[22] PCT Filed: Nov. 28, 1980

[86] PCT No.: PCT/AU80/00101

§ 371 Date: Jul. 15, 1981

§ 102(e) Date: Jul. 15, 1981

[87] PCT Pub. No.: WO81/01528

PCT Pub. Date: Jun. 11, 1981

[30] Foreign Application Priority Data

Nov. 29, 1979 [AU] Australia ..... PE1532

[51] Int. Cl.[3] ..... B05B 3/06; B05B 3/08

[52] U.S. Cl. ..... 239/381; 239/453

[58] Field of Search ..... 239/380–383, 239/241, 453, DIG. 1, 507, 512, 515

[56] References Cited

U.S. PATENT DOCUMENTS 3,677,472 7/1972 Hart et al. ..... 239/241

FOREIGN PATENT DOCUMENTS 103160 6/1962 Netherlands ..... 239/383

*Primary Examiner*—Andres Kashnikow

*Attorney, Agent, or Firm*—Gordon L. Peterson

[57] ABSTRACT

A butterfly sprinkler in which a rotating head has an upwardly projecting shaft to fit in a bearing supported by arms. The shaft is of stepped configuration with the bearing being of similar configuration to thus form a skirt about the bearing. A nozzle for the sprinkler is provided with a resilient flow regulator arranged in such a way that as pressure of the water fed to the sprinkler increases, the regulator is distorted to reduce the size of an orifice to limit the amount of water flowing to a relatively uniform rate irrespective of changes of pressure.

8 Claims, 3 Drawing Figures

BUTTERFLY SPRINKLER

Figure 1:
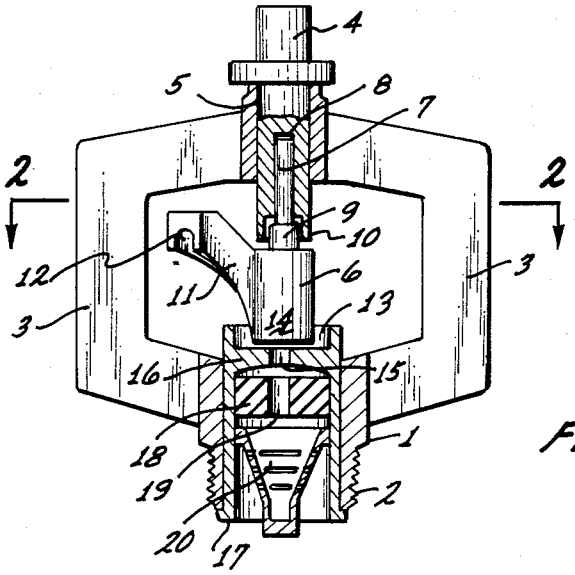

This invention relates generally to sprinklers of the known type which have a rotating head so arranged that when water is projected axially to the head and is guided by a curved channel to issue from the rotating head, the reaction causes the head to rotate.

In this type of sprinkler the rotating head has an upwardly projecting shaft which fits in a bearing supported by arms projecting upwards from a socket member by means of which the device is connected to a water supply line, the head rotating within a space formed between the arms.

It is known that in butterfly sprinklers of this type certain problems can occur, one being caused through the bearing for the rotating head having grit introduced into it with resultant wear and deteriorating rotation, and it is also known that the rotating head can be removed under some circumstances when not in operation by birds withdrawing the head from its bearing as the head when not raised is in a lowered position with its shaft partly withdrawn from the bearing, the head being raised during operation by the force of the water directed against its underside as it flows along the curved channel of the head.

Various other disadvantages exist with sprinklers of this type and it is an object of the present invention to provide certain improvements which will remove such disabilities.

It is an object of the invention to so arrange the sprinkler assembly that the shaft on which the rotating head operates will be protected against contamination by dirt.

It is a further object of the invention to provide effective supporting means for the rotating head when not lifted by the flow of water to ensure that it cannot be readily removed from the frame in which it operates.

It is a still further object of the invention to give closer control of the rate of rotation of the head and also to provide a flow regulator to ensure best operation in relation to pressures existing at the time.

The objects of the invention are achieved by forming the sprinkler with a rotational head supported from a body having at least one upstanding arm supporting a bearing in axial alignment with an orifice in a jet in the said body, characterised by a shaft upwardly projecting from the said head and arranged to engage in the bearing, the shaft having a larger diameter portion at the rotational head, the bearing having a depending skirt arranged to encircle the larger diameter portion of the shaft to form a protective shroud against ingress of foreign matter to the bearing, further characterised in that the bearing is positionable to allow the rotating head to be positioned over the jet and then held confined with some axial movement between the bearing and the body when the bearing is axially positioned.

The invention also includes means to limit lateral displacement of the lower end of the rotating head to restrict damage to the head by birds or animals or removal of the head by birds which is common with butterfly sprinklers known heretofore.

The assembly may also include pressure control means and a screen to remove solids from the water flowing through the sprinkler.

Figure 2:
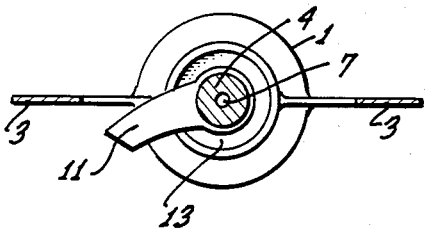
Figure 3:
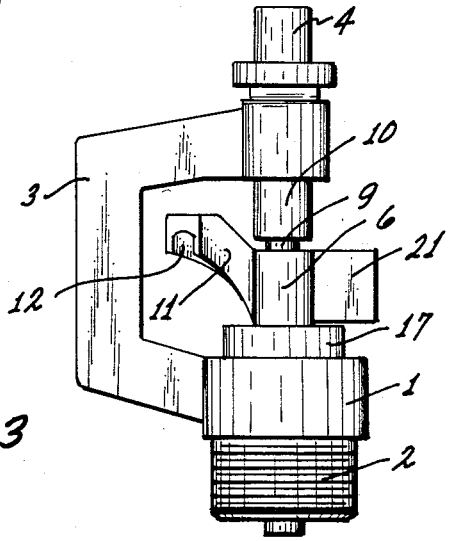

In order however that the invention may be more fully understood, an embodiment will now be described with reference to the accompanying drawings in which FIG. 1 is a part sectional side elevation of a preferred form of the sprinkler, FIG. 2 is a sectional plan of same on line 2—2 of FIG. 1, and FIG. 3 is a side elevation of a modified form of the invention.

The sprinkler illustrated in FIGS. 1 and 2 comprises a body 1 having a screw thread 2 whereby it can be secured to a stand pipe or the like, and has two arms 3—3 projecting upwardly to a bearing 4 which is located in a bore 5 at the junction of the arms, which arms 3—3 define a space in which the rotating head operates.

The rotating head 6 has an upwardly projecting shaft 7 which engages in the bearing 4, the shaft 7 and socket 8 of the bearing 4 being dimensioned so that when water pressure is exerted on the rotating head 6, the head is lifted into an upper operating position with the end of the shaft 7 bearing against the inner end of the socket 8.

The shaft 7 has a stepped configuration having a lower part 9 of larger diameter fitting into a dust skirt 10 extending down from the bottom of the bearing so that, when in its lowered position, the skirt 10 shrouds the larger lower part 9 of the shaft 7 to prevent dust or grit getting into the bearing itself which commences at the upper end of the skirt 10.

The rotating head 6 is generally similar to the heads used heretofore in that it comprises a moulding with a curved shaped director 11 in which is formed a channel 12 which terminates at the lower end to surround the axis of the shaft 7 of the rotating head and curves upwardly and outwardly to direct water laterally and is caused to rotate by the reaction due to the curve of the channel. The rotating head 6 extends downwardly sufficiently far to fit into a recess 13 which is axially arranged with the shaft 7 of the rotating head 6 so that limited lateral displacement only is possible of the lower part of the rotating head 6 to ensure that the head 6 and shaft 7 cannot be damaged or removed.

The lower part 14 of the rotating head 6 which extends into the recess 13 terminates above a jet orifice 15 which is formed in a membrane 16 extending across an insert sleeve 17 which lines a hollow in the body 1. The insert sleeve 17 also holds a resilient regulator 18 which is arranged in such a way that as pressure of the water fed to the sprinkler increases, the flow regulator 18 is distorted to reduce the size of the orifice 19 and thus limit the amount of water flowing to a relatively uniform rate irrespective of changes of pressures. The sleeve can be an interference fit in the body to hold it in position, allowing it to be driven into a bore in the body. The recess freely accommodates that end of the head 6 remote from the bearing 4 to prevent significant lateral displacement of that end of the head.

The flow regulator 18 has beneath it a slitted member forming a screen 20, the screen 20 being held in the sleeve 17 by being an interference fit in the sleeve 17.

The rotating head 6, in the embodiment shown, has a projecting web 21 on the opposite side to that from which the director 11 projects, the purpose of the web 21 being to effect some amount of slowing down by increasing air resistance when the rotating head 6 is operating to thereby somewhat slow down the rotation of the rotating head, and also to at least partly balance the rotating head.

By means of the construction described the rotating head 6 is confined in an upward direction by the end of the shaft 7 of the head contacting the end 8 of the bore in the bearing 4, and at that stage the enlarged part 9 of the shaft 7 is disposed within the dust seal skirt 10 at the bottom of the bearing 4, but when supply of water is terminated the rotating head 6 drops but not sufficiently to bring the enlarged part of the shaft 7 out of the dust seal skirt 10. This ensures that the shaft 7 itself is protected against dirt, the downward movement being limited by the lower end of the rotating head 6 contacting the membrane 16 which extends across the sleeve 17.

The rotating head 6 thus has limited up and down movement, and it will be appreciated that firstly the head has the upwardly projecting shaft 7 protected against contamination because it is housed in the bearing 4 and is protected by the dust seal skirt 10 which accommodates the larger portion 9 at the lower end of the shaft 7, while the lower end of the rotating head 6 is located loosely in the recess 13 which is formed in the sleeve 17. This then ensures that the rotating head is protected against removal by birds or the like because, not only is it supported against sideways displacement by the shaft 7 engaging in the bearing 4, but by its lower end fitting into the recess 13, limits sideways movement when relatively heavy forces are applied which could otherwise distort the spindle 7 sufficiently to damage the rotating head. The arrangement is such that the lower end of the rotating head is a loose fit in the recess 13 so that it is not guided by the wall of the recess but the wall merely limits excessive displacement of the lower part of the rotating head which as said could cause damage to the spindle or removal of the head.

The sprinkler constructed as described has a very free action in that the rotating head is adequately supported by a shaft engaging in a bearing which is protected against the ingress of foreign matter while removal of the rotating head is equally guarded against because the sideways pull will simply bring the lower part of the rotating head against the wall of the bore previously described.

While two arms have been referred to in the preferred construction which extend from the socket portion of the frame to support the bearing for the shaft of the rotating head it will be realised that a single arm would suffice as shown in FIG. 3, and it will also be realised that the bearing member needs to be removable, being an interference fit in the bore 5, so that the rotating head can be positioned to have the intake of the curved channel in the rotating head co-axial with the jet in the flow regulator and co-axial also with the shaft and bearing which support the rotating head. An interference fit is defined as any arrangement which allows the bearing to be located axially in the bore and held in position against displacement when positioned.

In use the rotating head 6 is located to have its axis of rotation co-axial with the orifice of the jet 15 and the bearing 4 is then driven into the bore 5, a distance just sufficient to allow some axial movement of the rotating head 6 to ensure that when water issuing from the orifice of the jet 15 lifts the rotating head, the thrust on the head is taken by the end of the spindle 7 against the end of the bore in the bearing 4, while the rotating head 6 has its lower part, which is located in the recess 13, lifted clear of the membrane 10 but loosely confined in the recess 13 so that there is no friction at this point but constraint against significant displacement.

The claims defining the invention are as follows:

1. A butterfly sprinkler having a rotational head and comprising a body having means to fix it to a support and having upstanding arm means thereon to support a bearing in axial alignment with an orifice in said body and shaped to define a space to accommodate said head characterized by a shaft upwardly projecting from the said head arranged to engage in the said bearing, the said shaft having a larger diameter portion at the said rotational head, the said bearing having a depending skirt arranged to encircle the said larger diameter portion of the shaft to form a protective shroud against ingress of foreign matter to the said bearing, further characterized in that the said bearing is positionable on the said arm means to allow the rotating head to be positioned over the said orifice and then held confined with some axial movement between the said bearing and the said body when the said bearing is positioned, said body being hollow, a cylindrical sleeve lining the said hollow body arranged co-axially with the said bearing and having a membrane extending across it near one end with said orifice therethrough co-axial with the said sleeve, said membrane with the said sleeve forming a recess in which that end of the said head remote from the said bearing is freely accommodated to prevent significant lateral displacement of that end of the said head.

2. A butterfly sprinkler according to claim 1 characterised by a recess in the said body adjacent the said orifice and co-axial therewith to encircle but not touch the lower end of the said rotating head to prevent lateral displacement thereof.

3. A butterfly sprinkler according to claim 1 further characterised by a regulator extending across the said sleeve formed of a resilient material and apertured to allow distortion of the regulator around the aperture and positioned to control water flow to the orifice.

4. A butterfly sprinkler according to claim 1 or 3 characterised by an apertured screen across the said sleeve to remove solids from the water before flowing through the orifice.

5. A butterfly sprinkler according to claim 1 characterised in that both the said bearing and sleeve are interference fit into respectively the said arm means and the said body. pg,10

6. A butterfly sprinkler according to claim 1 wherein the arm means includes a pair of arms having a junction and said bearing forms an interference fit with a bore in the junction of the pair of arms, said bore being co-axial with the orifice.

7. A butterfly sprinkler according to claim 1 wherein the arm means includes a single arm and said bearing forms an interference fit with a bore in said arm, the said bore being co-axial with the orifice.

8. A butterfly sprinkler according to claim 1 further characterised by a web and a curved director projecting from the opposite sides of said rotating head whereby the web forms rotation retarding and balancing means.

* * * * *